United States Patent [19]

Chiba

[11] Patent Number: 4,773,505

[45] Date of Patent: Sep. 27, 1988

[54] REFUGE APPARATUS

[76] Inventor: Hidesada Chiba, 18, Nishi 8-chome, Kita 22-jyo, Kita-ku, Sapporo-shi, Hokkaido, Japan

[21] Appl. No.: 108,537

[22] Filed: Oct. 15, 1987

[30] Foreign Application Priority Data

Aug. 5, 1987 [JP] Japan ..... 62-120240[U]

[51] Int. Cl.[4] ..... E04G 27/00; E04F 11/00

[52] U.S. Cl. ..... 182/49

[58] Field of Search ..... 182/49, 129

[56] References Cited

U.S. PATENT DOCUMENTS

| | | | |
|---|---|---|---|
| 3,063,513 | 11/1962 | Marryatt | 182/49 |
| 4,498,557 | 2/1985 | Horne | 182/49 |
| 4,606,431 | 8/1986 | Ruder | 182/49 |

*Primary Examiner*—Reinaldo P. Machado

*Attorney, Agent, or Firm*—Fleit, Jacobson, Cohn & Price

[57] ABSTRACT

A sliding chute to be set at one side of stairs from upstairs to downstairs.

This sliding chute is maintained in an erected state and can be used as a handrail at ordinary times. However, in an emergency such as during the chute fire, can be made to fall down on the stairs so that it may be used as a helping for refuging upstairs persons.

2 Claims, 3 Drawing Sheets

REFUGE APPARATUS

BACKGROUND OF THE INVENTION

This invention relates to a refuge apparatus for taking refuge from upstairs to downstairs in an emergency such as when a fire occurs or the like.

Heretofore, an emergency staircase, a refuge bag for sliding, etc. were used as means for taking refuge from upstairs to the ground in an emergency such as fire or the like in hospitals and old-age homes.

However, when there is no simple means for promptly taking refuge from upstairs to downstairs in a building, persons having leg trouble, patients and old persons may fail to reach safety and, thereby may be injured.

In view of the above facts, this invention is intended to provide a refuge apparatus which can set easily in an emergency, so that it is possible for persons to take refuge from upstairs to downstairs promptly.

SUMMARY OF THE INVENTION

In order to attain this object, a sliding chute which falls down on the stairs from an erected state, is provided at one side of the stairs from upstairs to downstairs.

By making the sliding chute fall down on the stairs in an emergency, those who have leg trouble, patients and old persons can get to refuge promptly from an accident by sliding down along the sliding chute.

BRIEF DESCRIPTION OF THE DRAWINGS

An embodiment of this invention will now be described with reference to the accompanying drawings, in which.

DETAILED DESCRIPTION OF THE INVENTION

Now, an example of this invention will be described with reference to the drawings as follows.

Figure 2:
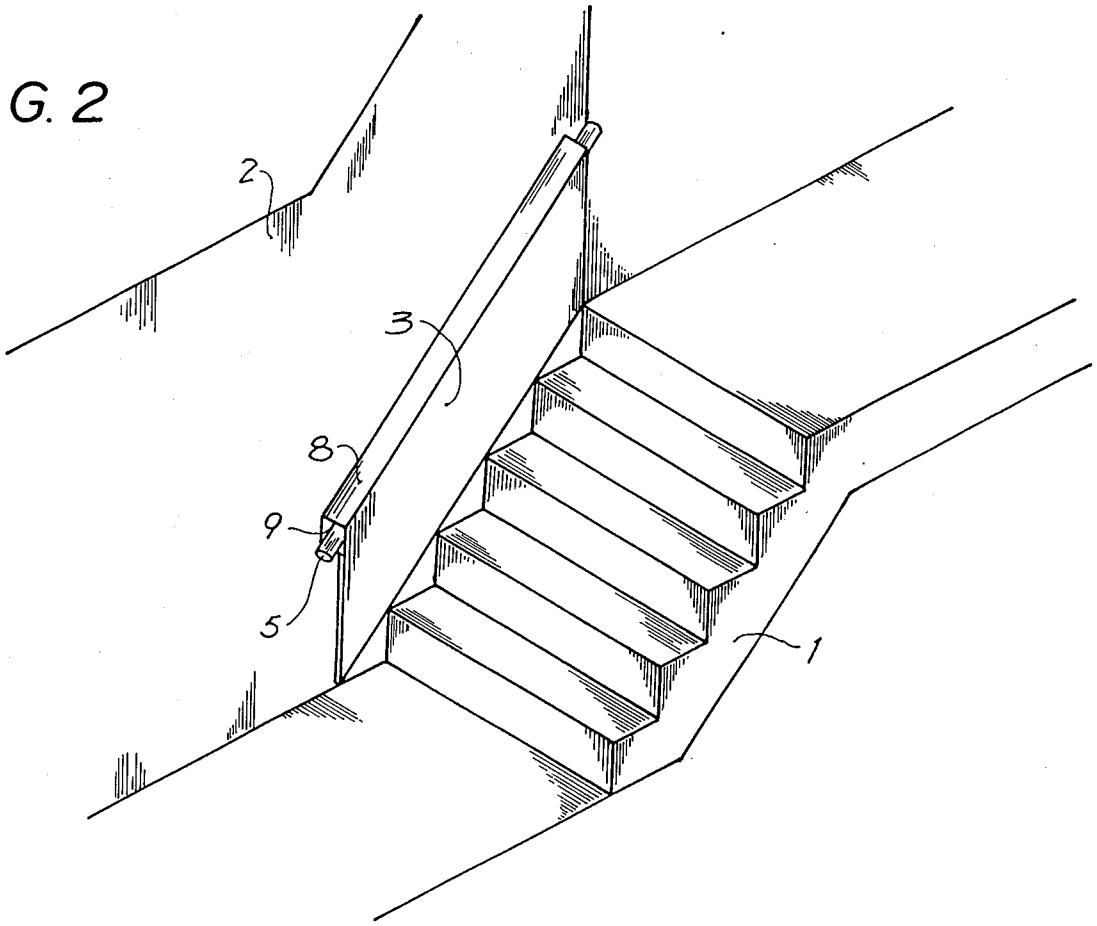
FIG. 2 shows a perspective view in which the sliding chute is in an erected state.

A sliding chute 3 having the form of a long plate is mounted rotatively to a wall surface 2 at a plurality of lower portions of chute 3 with hinges 4 at the side of the wall surface 2 of the stairs 1. At the upper portion of this sliding chute, as can be seen in FIG. 2, a protrusion 8 which project towards the wall surface side 2 is formed in a longitudinal direction, said protrusion 8 being provided with hole 9. Further, the hole 9 has an operation rod 5 which penetrates therethrough, said operation rod

Figure 3:
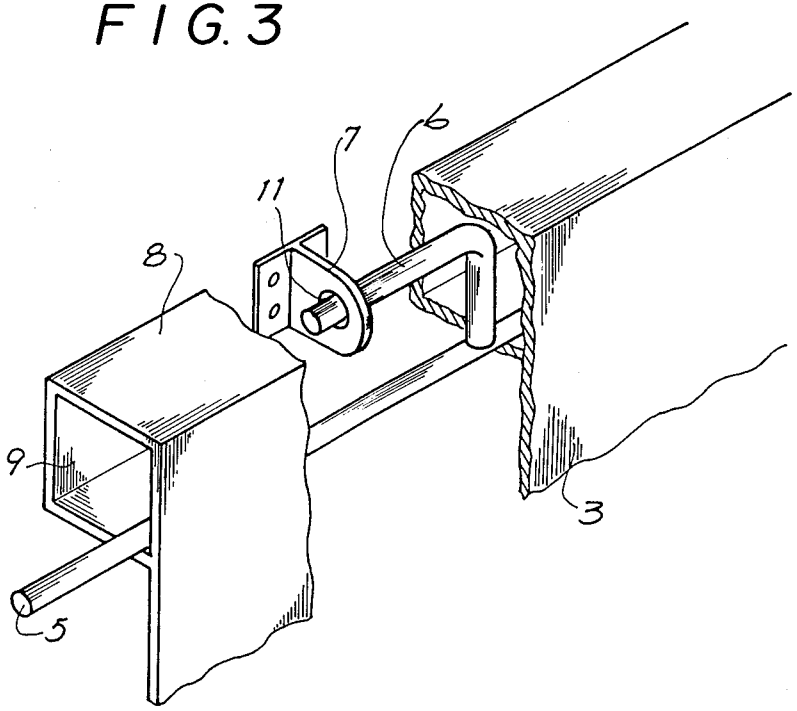
FIG. 3 is an enlarged perspective of the erectly standing condition which shows a partially cut away view of the invention.

5 being provided with branched latching portions 6 at several portions as shown at a part thereof in FIG. 3.

Furthermore, small holes 10 (FIG. 1) are perforated at the side portion of the wall surface 2 of the protrusion 8 and correspond to the site of said latching portion 6. Still further, metal fittings 7 inserted into the hole 9 through said small holes 10 are respectively secured to portions of walls surface 2 to correspond to each small hole 10. A hole 11 in which said latching portion 6 can be latched is perforated at each metal fitting 7.

The sliding chute 3 is usually in an erected state as shown in FIG. 2 and FIG. 3. In this erected state, the sliding chute 3 can be used as a handrail, since the latching portion 6 of the operation rod 5 is latched with the holes 11 of the metal fittings 7.

Figure 1:
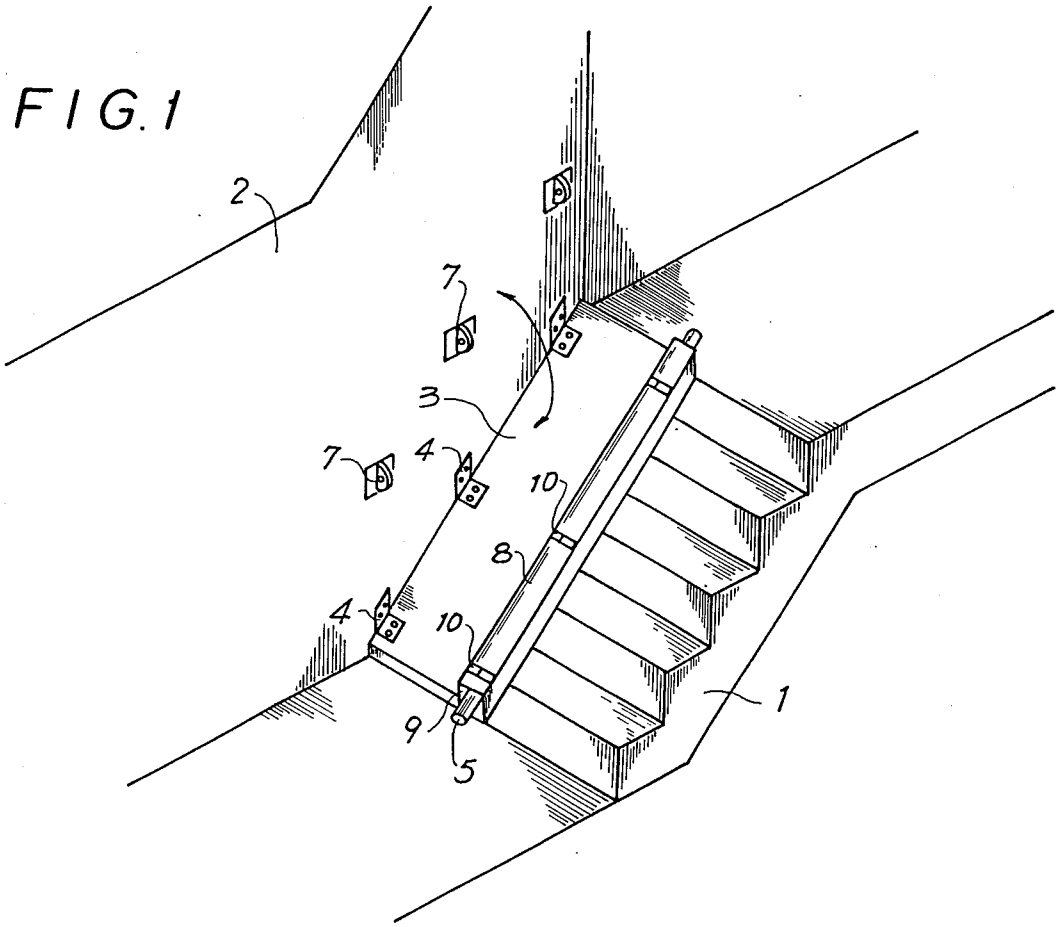
FIG. 1 shows a perspective view in which the sliding chute is in an overturned state.

However, in an emergency such as a fire, when the upper end of the operation rod 5 is somewhat pulled up at the upperstair side or the lower end thereof is somewhat pushed up at the lowerstair side , each latching portion 6 of the rod 5 is disconnected from each hole of each metal fitting 7, thereby allowing the sliding chute 3 to rotate about hinges 4 to fall down on the stairs 1 as shown in FIG. 1.

By this, individuals who are upstairs can take refuge by moving downstairs promptly by sliding down along the sliding chute 3. In this case, since the protrusion 8 is provided at one side of the sliding chute slipping can be avoided.

According to the invention as described above, since the sliding chute can be easily lowered when an emergency, such as a fire not only patients, people who have trouble in their legs, occurs the old-aged but also a healthy person may avoid danger promptly by sliding down from upstairs.

Further, the sliding stand can be used as the handrail at normal times.

What I claim is:

1. A refuge apparatus provided with a sliding chute which stands in an erected state at ordinary times and is made to fall down on stairs in an emergency at one side of the stairs comprising:

a sliding stand mounted rotatively to a wall at one side of the stairs;

a plurality of hinges at lower portions of said wall;

a protrusion which projects toward the wall surface along a longitudinal direction of the sliding chute at a top end thereof, said protrusion being provided with a hole; and an operation rod having a plurality of branched latching portions inserted through said hole for latching said sliding chute in said erected state.

2. A refuge apparatus according to claim 1 wherein small holes are provided in a side portion of the protrusion at the site of the latching portions and further wherein metal fittings are inserted in said small holes when said sliding chute is in said erected state, each metal fitting being provided with a latching hole within which the latching portion can be inserted.

* * * * *